US007445385B2

(12) United States Patent
Lin

(10) Patent No.: US 7,445,385 B2
(45) Date of Patent: Nov. 4, 2008

(54) DEVICE FOR TESTING HEAT CONDUCTION PERFORMANCE OF HEAT PIPE

(75) Inventor: Mong-Tung Lin, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 232 days.

(21) Appl. No.: 11/400,881

(22) Filed: Apr. 10, 2006

(65) Prior Publication Data

US 2007/0006995 A1 Jan. 11, 2007

(51) Int. Cl.
*G01K 13/00* (2006.01)
*G01K 7/00* (2006.01)

(52) U.S. Cl. ..... 374/147; 374/166; 374/141; 165/288

(58) Field of Classification Search ..... 374/166, 374/147, 141; 165/288
See application file for complete search history.

(56) References Cited

U.S. PATENT DOCUMENTS 3,682,239 A * 8/1972 Abu-Romia ..... 165/104.26
4,058,160 A * 11/1977 Corman et al. ..... 165/104.26
4,640,347 A * 2/1987 Grover et al. ..... 165/104.26
2004/0244963 A1* 12/2004 Hazelton ..... 165/272
2005/0220168 A1 10/2005 Chien
2006/0256834 A1* 11/2006 Chang et al. ..... 374/5
2007/0110121 A1* 5/2007 Hsu ..... 374/147

FOREIGN PATENT DOCUMENTS

JP 58140593 A * 8/1983
JP 581987735 A * 11/1983
JP 59010824 A * 1/1984

* cited by examiner

*Primary Examiner*—Edward Lefkowitz
*Assistant Examiner*—Mirellys Jagan
(74) *Attorney, Agent, or Firm*—Andrew C. Cheng

(57) ABSTRACT

A device for testing heat conduction performance of a heat pipe is provided. In which the heat pipe to be tested includes an evaporating section and a condensing section. The device includes a block, a cooling device, a thermal interface material, a heating element for heating the block and a plurality of thermal probes. The block is coupled with the evaporating section of the heat pipe. The cooling device is coupled with the condensing section of the heat pipe. The thermal interface material is configured to be at a coupling interface between the block and the evaporating section of the heat pipe. The thermal probes are inserted into the block and the cooling device to measure the respective temperatures of distinct regions in the block and the cooling device where the thermal probes are located.

16 Claims, 1 Drawing Sheet

DEVICE FOR TESTING HEAT CONDUCTION PERFORMANCE OF HEAT PIPE

TECHNICAL FIELD

The present invention relates to a measuring device and, particularly, to a device which can accurately measure heat conduction performance of a heat pipe.

BACKGROUND

Heat pipes have been suggested for cooling electronic components. Generally, a heat pipe includes an evaporating section to take in heat and a condensing section to expel heat. A working fluid is contained in the heat pipe for transferring heat from the evaporating section to the condensing section. In use, heat absorbed by the evaporating section of the heat pipe boils the working fluid, and then, the working fluid is converted into a vapor. The vapor travels to the condensing section where it condenses to a liquid and gives up its heat. The liquid returns back to the evaporating section by gravity or a wick, and then the cycle starts again.

However, a heat pipe has its limits such as wicking limit, boiling limit and entrainment limit. Measuring devices can measure a heat conduction performance of the heat pipe to determine which limit affects the heat conduction. A conventional measuring device for measuring the heat conduction of a heat pipe includes a first platform, a second platform, a heating element, a cooling element and a plurality of thermal probes. The first platform defines a plurality of first holes for receiving the evaporating section of the heat pipe, the heating element and the thermal probes. The second platform defines a plurality of second holes for receiving the condensing section of the heat pipe, the cooling element and the thermal probes. However, the evaporating section of the heat pipe is connected with the first platform directly and rigidly, inevitably, a number of small gaps exist between an outer surface of the evaporating section and an inner surface defining the first hole for receiving the evaporating section of the heat pipe. Air in the small gaps unduly increases thermal resistance. This may result in an error between measuring values and the actual heat conduction performance of the heat pipe.

Thus, an improved device which can accurately test heat conduction performance of a heat pipe is desired.

SUMMARY

A device for testing heat conduction performance of a heat pipe is provided. In which the heat pipe to be tested includes an evaporating section and a condensing section. The device includes a block, a cooling device, a thermal interface material, a heating element for heating the block and a plurality of thermal probes. The block is coupled with the evaporating section of the heat pipe. The cooling device is coupled with the condensing section of the heat pipe. The thermal interface material is configured to be at a coupling interface between the block and the evaporating section of the heat pipe. The thermal probes are inserted into the block and the cooling device to measure the respective temperatures of distinct regions in the block and the cooling device where the thermal probes are located.

Advantages and novel features of the present device for testing heat conduction performance of a heat pipe will become more apparent from the following detailed description of preferred embodiments when taken in conjunction with the accompanying drawings.

BRIEF DESCRIPTION OF THE DRAWINGS

Many aspects of the present device for testing heat conduction performance of a heat pipe can be better understood with reference to the following drawings. The components in the drawing are not necessarily drawn to scale, the emphasis instead being placed upon clearly illustrating the principles of the present device. Moreover, in the drawings, like reference numerals designate corresponding parts throughout the several views.

DETAILED DESCRIPTION OF PREFERRED EMBODIMENTS

Figure 1:
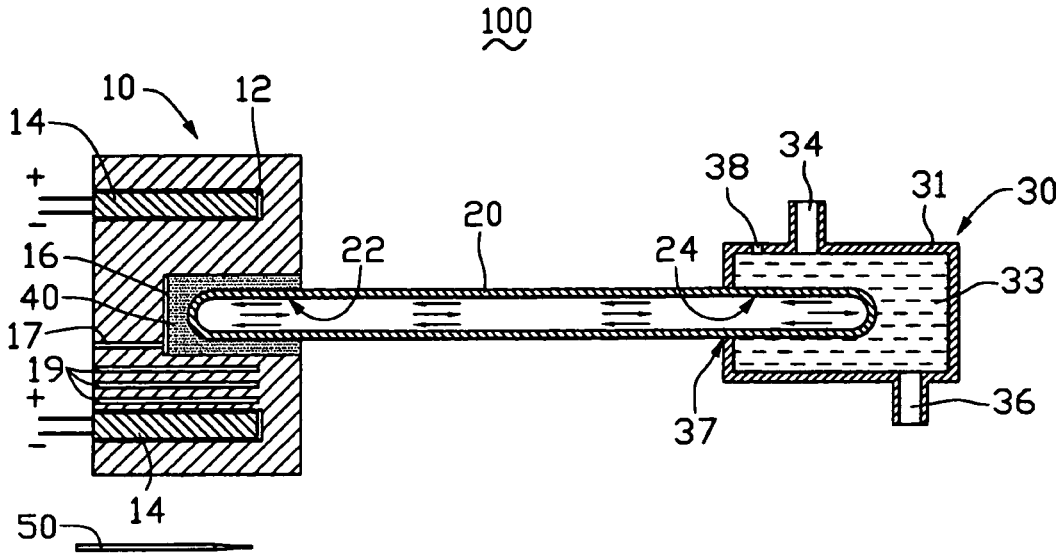
FIG. 1 is a schematic, cross-sectional view of a device for testing heat conduction performance of a heat pipe, in accordance with a first embodiment.

Referring to FIG. 1, a device 100 for testing heat conduction performance of a single-pipe type heat pipe 20 in accordance with a first exemplary embodiment is shown. The heat pipe 20 to be tested includes an evaporating section 22 and a condensing section 24. The device 100 includes a block 10, a plurality of heating elements 14, a cooling device 30, a thermal interface material 40, and a plurality of thermal probes 50. The block 10 is coupled with the evaporating section 22 of the heat pipe 20. The cooling device 30 is coupled with the condensing section 24 of the heat pipe 20. The thermal probes 50 can be thermometers, thermocouples and such like. The block 10 can be made of heat conducting materials, such as metals or alloys with excellent heat conduction performance. In this embodiment, the block 10 is made of copper.

The block 10 defines a first receiving hole 16 for heating the evaporating section 22 of the heat pipe 20, a plurality of mounting holes 12 for receiving the heating elements 14, a first measuring hole 17 and a plurality of second measuring holes 19 for receiving the thermal probes 50. The first measuring hole 17 is in communication with the first receiving hole 16, receiving the thermal probe 50 so as to measure a temperature of the evaporating section 22 of the heat pipe 20. The second measuring holes 19 are defined in the block 10 parallel to each other, facilitating measuring the temperatures of respective regions in the block 10 where the thermal probes 50 are located. Thus, a temperature gradient of the block 10 can be measured.

The cooling device 30 includes a cooling container 31 and a cooling medium 33 contained therein. The cooling container 31 can be made of heat conducting materials, such as metals or alloys with excellent heat conduction performance. In this embodiment, the cooling container 31 is made of copper. The cooling container 31 defines a second receiving hole 37 for cooling the condensing section 24 of the heat pipe 20 and a plurality of third measuring holes 38 for receiving the thermal probes 50. The third measuring holes 38 is configured to be in communication with the second receiving hole 37, through which the thermal probe 50 can be inserted, and a temperature of the condensing section 24 of the heat pipe 20 can be measured. In addition, the cooling container 31 defines an inlet 34 for introducing the cooling medium 33 and an outlet 36 for releasing the cooling medium 33. Thus, the cooling medium 33 can continuously flow through the cooling container 31. The cooling medium 33 can be composed of a high heat capacity material, such as water, liquid nitrogen, and the like. p The thermal interface material 40 is configured to be at a coupling interface between the black 10 and the evaporating section 22 of the heat pipe 20 for connecting the evaporating section 22 with inside walls of the first receiving hole 16. The thermal interface material 40 may be phase change materials or polymer materials. The phase change material may be selected from the group consisting of olefin, polyolefin, low molecular weight polyester. low molecular weight epoxide resin, and low molecular weight acrylic acid. The polymer material may be selected from the group consisting of silicone rubber, polyester, poly vinyl chloride, poly vinyl alcohol, polyethylene, polypropylene, epoxide resin, polycarbonate, polyacetal, polyoxymethylene, and any combination thereof. The thermal interface material 40 may include thermally conductive particles selected from the group consisting of copper, aluminum particles, silver particles, aluminum oxide particles, zinc oxide particles, aluminum nitride particles, boron nitride particles, graphite particles, carbon nano-particles and any suitable combination thereof.

Figure 2:
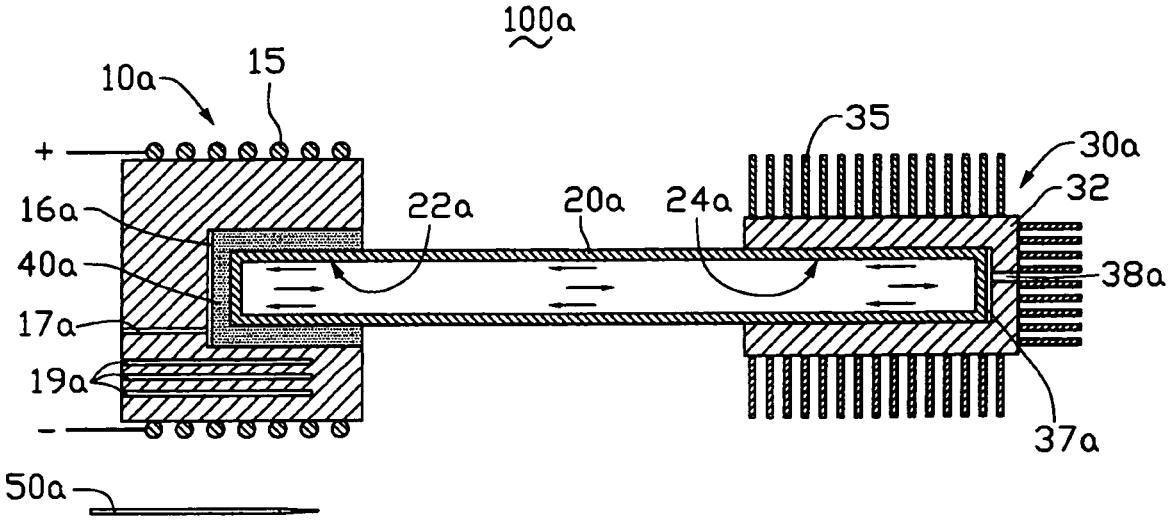
FIG. 2 is a schematic, cross-sectional view of a device for testing heat conduction performance of a heat pipe, in accordance with a second embodiment.

FIG. 2 shows a device 100*a* for testing heat conduction performance of a planar plate heat pipe 20*a* in accordance with a second embodiment. The heat pipe 20*a* to be tested includes an evaporating section 22*a* and a condensing section 24*a*. The device 100*a* includes a block 10*a*, an electrical resistance wire 15, a cooling device 30*a*, a thermal interface material 40*a*, and a plurality of thermal probes 50*a*. The block 10*a* is coupled with the evaporating section 22*a*. The cooling device 30*a* is coupled with the condensing section 24*a*. The block 10*a* can be made of heat conducting materials, such as metals or alloys with excellent heat conduction. In this embodiment, the block 10*a* is made of copper.

The electrical resistance wire 15 is coiled around the block 10*a* so as to heat the block 10*a*. The block 10*a* defines a first receiving hole 16*a* for heating the evaporating section 22 of the heat pipe 20*a*, a first measuring hole 17*a* and a plurality of second measuring holes 19*a* for receiving the thermal probes 50*a*. The first measuring hole 17*a* is in communication with the first receiving hole 16*a*, for receiving the thermal probe 50*a* to measure a temperature of the evaporating section 22*a* of the heat pipe 20*a*. The second measuring holes 19*a* are defined in block 10*a* parallel to each other, for measuring the temperatures of the respective regions in the block where the thermal probes 50 are located. Thus, a temperature gradient of the block 10*a* can be measured.

The cooling device 30*a* can be made of heat conducting materials, such as metals or alloys with excellent heat conduction. In this embodiment, the cooling device 30*a* is made of copper. The cooling device 30*a* is a heat sink module including a base 32 and a plurality of fins 35 formed on the base 32 for dissipating heat from the base 32. The base 32 defines a second receiving hole 37*a* for cooling the condensing section 24*a* of the heat pipe 20*a* and a plurality of third measuring holes 38*a* for receiving the thermal probe 50*a*. The third measuring holes 38*a* are configured to be in communication with the second receiving hole 37*a*, through which the thermal probe 50*a* can be inserted, and a temperature of the condensing section 24*a* of the heat pipe 20*a* can be measured. The thermal interface material 40*a* includes silicon rubber material and a number of carbon nanotubes dispersed therein. Similar to the first embodiment, the thermal interface material 40*a* is configured to be at a coupling interface between the block 10*a* and the evaporating section 22*a* of the heat pipe 20*a*, and tightly combines the evaporating section 22*a* with inside walls of the heating space 16*a*.

The device 100*a* can provide realistically work-like conditions for the heat pipe 20*a*. When the temperatures of the evaporating section 22*a* and the condensing section of the 24*a* are both stabilized, a series of temperature values associated with the evaporating section 22*a* can be measured by the thermal probe 50 inserted in the first measuring hole 17*a*. Similarly, a series of temperature gradient values associated with the block 10*a* can be measured by the thermal probes 50 respectively inserted the second measuring holes 19*a*. Also, a series of temperature values associated with the condensing section 24*a* can be measured by the thermal probe 50*a* inserted in the third measuring hole 38*a*. Using these values, the temperature difference between the evaporating section 22*a* and the condensing section 24*a* can be calculated. Moreover, other heat conducting parameters that determine the performance of the heat pipe 20*a*, such as the maximum quantity of heat transfer, the heat transfer resistance, can also be calculated.

In measuring the heat conductivity of the heat pipe, the thermal interface material can increase absorption speed of the evaporating section of the heat pipe from the block. Therefore, a more precise temperature value for the evaporating section of the heat pipe can be measured. As a result of the above explained advantages, the measuring device can be more accurately explain the heat conducting characters of the heat pipe.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A device for testing heat conduction performance of a heat pipe, the heat pipe comprising an evaporating section and a condensing section, the device comprising:

a block defining a first receiving hole for receiving the evaporating section of the heat pipe;

a cooling device for coupling with the condensing section of the heat pipe;

a thermal interface material in the first receiving hole, the thermal interface material being configured for connecting the evaporating section of the heat pipe with inside walls of the first receiving hole at a coupling interface between the block and the evaporating section of the heat pipe;

a heating element for heating the evaporating section of the heat pipe;

a plurality of thermal probes inserted into the block and the cooling device for measuring the respective temperatures of distinct regions in the block and the cooling device where the thermal probes are located.

2. The device for testing heat conduction performance of a heat pipe as described in claim 1, wherein the block defines a mounting hole for receiving the heating element.

3. The device for testing heat conduction performance of a heat pipe as described in claim 1, wherein the heating element is an electrical resistance wire surrounding the block.

4. The device for testing heat conduction performance of a heat pipe as described in claim 1, wherein the thermal interface material is comprised of a phase change material or a polymer with thermally conductive particles dispersed therein.

5. The device for testing heat conduction performance of a heat pipe as described in claim 4, wherein the phase change material is one of olefin and polyolefin.

6. The device for testing heat conduction performance of a heat pipe as described in claim 4, wherein the polymer is selected from the group consisting of silicone rubber, polyester, poly vinyl chloride, poly vinyl alcohol, polyethylene, polypropylene, epoxide resin, polycarbonate, polyacetal, polyoxymethylene, and any combination thereof.

7. The device for testing heat conduction performance of a heat pipe as described in claim 4, wherein the thermally conductive particles are comprised of material selected from the group consisting of copper, aluminum, silver, aluminum oxide, zinc oxide, aluminum nitride, boron nitride, graphite, carbon nano-materials, and any combination thereof.

8. The device for testing heat conduction performance of a heat pipe as described in claim 1, wherein the block defines a first measuring hole in communication with the first receiving hole, and the first measuring hole is configured for receiving one of the plurality of thermal probes to measure the temperature of the evaporating section of the heat pipe.

9. The device for testing heat conduction performance of a heat pipe as described in claim 8, wherein the block defines a plurality of second measuring holes for receiving other thermal probes of the plurality of thermal probes to measure the temperatures of the respective regions in the block in which the other thermal probes are located.

10. The device for testing heat conduction performance of a heat pipe as described in claim 9, wherein the cooling device is a heat sink module.

11. The device for testing heat conduction performance of a heat pipe as described in claim 10, wherein the heat sink module comprises a base and a plurality of fins formed on the base.

12. The device for testing heat conduction performance of a heat pipe as described in claim 11, wherein the base defines a plurality of third measuring holes for receiving other thermal probes of the plurality of thermal probes to measure temperatures of the condensing section of the heat pipe.

13. The device for testing heat conduction performance of a heat pipe as described in claim 9, wherein the cooling device comprises a cooling container and a cooling medium contained therein.

14. The device for testing heat conduction performance of a heat pipe as described in claim 13, wherein the cooling container defines a second receiving hole for receiving the condensing section of the heat pipe.

15. The device for testing heat conduction performance of a heat pipe as described in claim 13, wherein the cooling container defines a plurality of third measuring holes for receiving other thermal probes of the plurality of thermal probes to measure the temperature of the condensing section of the heat pipe.

16. The device for testing heat conduction performance of a heat pipe as described in claim 13, wherein the condensing section of the heat pipe is immersed in the cooling medium.

* * * * *